US005610701A

United States Patent [19]

Terada et al.

[11] Patent Number: 5,610,701

[45] Date of Patent: Mar. 11, 1997

[54] COLOR ELECTROPHOTOGRAPHIC APPARATUS AND IMAGE FORMING UNITS USED THEREIN

[75] Inventors: Hiroshi Terada, Ikoma; Hajime Yamamoto, Ibaraki; Masahiko Nakamura, Hirakata, all of Japan

[73] Assignee: Matsushita Electric Industrial Co., Ltd., Osaka, Japan

[21] Appl. No.: 276,704

[22] Filed: Jul. 18, 1994

[30] Foreign Application Priority Data

| | | | |
|---|---|---|---|
| Jul. 20, 1993 | [JP] | Japan | 5-178993 |
| Jul. 20, 1993 | [JP] | Japan | 5-178998 |
| Jul. 27, 1993 | [JP] | Japan | 5-184976 |
| Jul. 28, 1993 | [JP] | Japan | 5-186041 |

[51] Int. Cl.[6] ..... G03G 15/01

[52] U.S. Cl. ..... 399/298; 399/227; 399/221; 399/167

[58] Field of Search ..... 355/200, 210, 355/326 R, 327, 328

[56] References Cited

U.S. PATENT DOCUMENTS

| | | | |
|---|---|---|---|
| 4,077,358 | 3/1978 | Kito | 118/658 |
| 4,697,915 | 10/1987 | Hayashi et al. | 355/327 |
| 4,743,938 | 5/1988 | Ohno | 355/327 |
| 5,198,866 | 3/1993 | Kimura et al. | 355/326 |
| 5,267,001 | 11/1993 | Kanai et al. | 355/200 X |
| 5,351,115 | 9/1994 | Yamamoto et al. | 355/326 R |

FOREIGN PATENT DOCUMENTS

| | | |
|---|---|---|
| 0035170 | 2/1981 | European Pat. Off. . |
| 0259839 | 9/1987 | European Pat. Off. . |
| 62-287264 | 12/1987 | Japan . |
| 1252982 | 10/1989 | Japan . |
| 1250970 | 10/1989 | Japan . |
| 2183276 | 7/1990 | Japan . |
| 5307322 | 11/1993 | Japan . |

*Primary Examiner*—Fred L. Braun
*Attorney, Agent, or Firm*—Price, Gess & Ubell

[57] ABSTRACT

A color electrophotographic apparatus for forming color images has advantages of compact and simple construction, easy positioning of an exposure position and easy inspection. The apparatus includes a plurality of rotatable image forming units corresponding to the number of colors, each of the units including a pivotable photosensitive member on which a toner image is formed and a developing device containing a color toner. The apparatus further includes an exposure device for exposing a toner image by emitting a signal light from outside of the image forming units and a mirror for reflecting the signal light to an exposure position, the mirror being placed in the neighbor of a rotation axis.

27 Claims, 6 Drawing Sheets

COLOR ELECTROPHOTOGRAPHIC APPARATUS AND IMAGE FORMING UNITS USED THEREIN

BACKGROUND OF THE INVENTION (1) Field of the Invention

The present invention relates to a color electrophotographic apparatus which is applicable to color printers, color copy machines, color facsimiles, and the like, and also to image forming units to be used in such a color electrophotographic apparatus.

(2) Related Arts

Color electrophotographic apparatuses generally form color images by superimposing yellow, magenta, cyan, and black toner images and transferring them onto a transfer member in accordance with either the transfer drum system or the sequential superimpose system.

According to the transfer drum system, different color toner images are sequentially formed on a single photosensitive member, and then transferred onto a transfer member such as paper rolled over the transfer drum by rotating the transfer drum. The relative position of these color toner images is adjusted by rotating the photosensitive member at the same speed as the transfer member and by matching the top end of each color toner.

Japanese Laid-open Patent Application No. 1-252982 shows a color image forming apparatus which employs the transfer drum system. According to this apparatus, a yellow toner image is first formed onto a rotating photosensitive drum and transferred onto a predetermined position on paper as a transfer member rolled over the outer surface of a transfer drum. Then, magenta, cyan, and black toner images are sequentially formed on the photosensitive drum and then transferred onto the predetermined position in the same manner as the yellow toner image. As a result, a color image is formed on the paper.

The transfer drum system has an advantage of managing with one photosensitive drum and a single exposure position. However, as its disadvantages, the neighboring portion of the developers and the photosensitive member tends to have very complicated construction because the positional correlation between the photosensitive member and each of the developers must be accurate.

In addition, troublesome operations for correlative positioning of the developers and the photosensitive member, or for adjusting the process conditions are necessary in maintenance, and another correlative positioning operation between the photosensitive member and each of the developers or the adjusting operation of the process conditions are necessary when the photosensitive member is replaced with another.

In contrast, according to the sequential superimpose system, an individual image forming unit is assigned to each toner color and a transfer member is conveyed on a belt or the like to pass an image forming position. As a result, each image forming unit transfers a respective toner image onto the transfer member.

Japanese Laid-open Patent Application No. 1-250970 shows a color image forming apparatus which employs the sequential superimpose system. According to this apparatus, four image forming stations each having a photosensitive member and an image exposure unit are arranged for forming color images. Paper is conveyed on a belt to pass under the four image forming stations, and as a result, four toner images are sequentially superimposed to form a color image.

The sequential superimpose system does not need a transfer drum, and accordingly there is no need to roll a transfer member over the transfer drum. In addition, the positional adjustment operation between the photosensitive drums and the developers is easy because each photosensitive drum and each developer are formed as a pair. However, providing an image forming unit for each color demands image exposure units such as laser beam systems which correspond to the number of the image forming units. This makes the construction of this portion complicated and expensive.

Furthermore, each image forming unit has its own exposure position, so that the positional correlation among the latent images formed by the image forming units greatly affects on the positional correlation among the different color toner images to be formed onto the transfer member. Therefore, the positional adjustment of the latent images formed by the image exposure units must be very accurate, and consequently, complicated construction is demanded to avoid positional disaccord as described in Japanese Laid-open Patent Application No. 1-250970.

On the other hand, another type of color electrophotographic apparatus has been developed. For example, the color electrophotographic apparatus described in Japanese Laid-open Patent Application No. 62-287264 has several electrophotographic process cartridges corresponding to the number of toner colors. According to this apparatus, each cartridge, which includes a photosensitive member and a developer having a toner, is sequentially conveyed to the image forming position. And the photosensitive member is exposed and developed for forming images which are to be transferred onto the transfer member on the transfer drum.

The cartridges are attached to a rotor frame whose rotation conveys the cartridges to the image forming position sequentially. The exposing operation for the photosensitive member is carried out by reflecting a beam emitted from outside of the rotor frame through a mirror fixed inside the rotor frame to lead the beam to a predetermined exposure position.

In this color electrophotographic apparatus, the photosensitive member and the developers can be repaired only by exchanging the cartridges, and positioning of the exposure position is very simple because the exposure position is fixed.

However, the mirror to be provided inside the rotary frame for leading a signal light to the photosensitive member demands a space for a light path to lead the signal light to the mirror.

Furthermore, in order to avoid collision between the mirror and the cartridges, the mirror is designed to be able to move away from the path for the cartridges. Or in the case where the mirror is fixed, the mirror is placed out of the path for the cartridges, making a space for the mirror in the rotary frame.

Thus the color electrophotographic apparatus has a problem that reducing the size of the rotary frame is difficult when the mirror is fixed and an additional problem that positioning of each exposure position is difficult when the mirror is movable. The difficulty in the size reducing of the rotary frame leads to the difficulty in the size reducing of the color electrophotographic apparatus.

On the other hand, in order to obtain a clear color image with few jitters, the photosensitive member must rotate at a fixed speed while an image is being formed. This is achieved by binding the drive axis of the photosensitive member with a fly wheel having a large inertia. However, such complicated construction having a fly wheel for every one of the plurality of photosensitive members makes maintenance laborious.

SUMMARY OF THE INVENTION

A first object of the present invention is to provide a compact color electrophotographic apparatus which can simplify maintenance and a positioning of an exposure position, and further to provide an image forming unit to be used for the color electrophotographic apparatus.

The first object can be achieved by a color electrophotographic apparatus for forming a color image by superimposing and transferring a plurality of toner images onto a transfer material. The apparatus comprises the following units:

A plurality of image forming units each forming a respective toner image and including a rotating photosensitive member on which a toner image is formed and a developing unit which contains a color toner. The image forming units are so arranged in a form of a circle to be rotated around a rotation axis. The transfer unit transfers a toner image formed on the photosensitive member onto the transfer member, a transferring operation of a toner image being performed on a transfer position in the color electrophotographic apparatus.

A light emitting unit emits a signal light to the rotation axis from outside of the image forming units.

A rotation unit rotates the image forming units around the rotation axis so that they reach an image forming position in sequence, the image forming position corresponding to the transfer position.

A drive unit rotates the photosensitive member of an image forming unit when it stands on the image forming position.

A mirror reflects the emitted signal light to lead to the image forming position, the mirror being placed in the center of the circle formed by the image forming units. The adjacent ones of the image forming units have a gap therebetween and at least a part of the gap being a part of a light path for leading the signal light from the light emitting unit to the mirror.

Each of the image forming units may have a substantially fan-shaped section vertical to the rotation axis, and they may have a circular section vertical to the rotation axis.

The above-explained color electrophotographic apparatus may further comprise a fixed cylindrical axis, which is either entirely transparent or having a transparent window. The fixed cylindrical axis may be concentric with the rotation axis. The mirror may be placed inside of the fixed cylindrical axis.

When the fixed cylindrical axis is horizontal, the light emitting unit may emit the signal light from a lower position than the mirror, and a reflection surface of the mirror may be diagonally downwards.

Each of the image forming units may further include a cleaning unit for cleaning off toners on the photosensitive member. When an image forming unit stands on the image forming position, its developing unit may be positioned above its photosensitive member and its cleaning unit may be positioned below the photosensitive member.

The electrophotographic apparatus may further comprise the following units.

A plurality of openable drum-covers protect a respective photosensitive member of the image forming units.

A cover opening unit controls an opening and closing operation of the drum-covers in accordance with a rotating operation of the image forming units and opens the drum-cover of an image forming unit standing on the image forming position.

The image forming units may be detachable from the color electrophotographic apparatus when they are located on a predetermined position, which is not the image forming position. The cover opening unit may keep the drum-covers closed when the image forming units are not located on the image forming position.

When the image forming units pass by the transfer position, their drum-covers may stay back from the outermost circular arc which is traced by the photosensitive members while the image forming units rotate.

The drive unit may include the following units:

A driving gear is concentric with the rotation axis, and rotates independently of the rotation axis.

A conveyance unit conveys the driving force of the driving gear to the photosensitive members when the image forming units stand on the image forming position.

The drive unit may further include a conveyance suspension unit for suspending a conveying operation of the conveyance unit to the photosensitive members when the image forming units are not located on the image forming position.

The drive unit may further include a fly wheel which is concentric with the rotation axis and rotates independently of the rotation axis, and a conveyance unit for conveying the driving force of the fly wheel to the photosensitive members when the image forming units stand on the image forming position.

The drive unit may further include a conveyance suspension unit for suspending the conveying operation of the conveyance unit to the photosensitive members when the image forming units are not located on the image forming position.

The rotation unit may include a frame for holding the image forming units in a body, and a justification unit for justifying the image forming units when they stand on the image forming position, thereby transferring a toner image onto the transfer member.

The first object can be also achieved by an image forming unit, a plurality of which are used in a color electrophotographic apparatus for forming a color image by superimposing and transferring a plurality of toner images onto a transfer material at a transfer position.

The plurality of image forming units are so arranged as to form a circular section vertical to a first rotation axis and are rotated around the first rotation axis, thereby sequentially reaching an image forming position. Each of the image forming units has a substantially fan-shaped section vertical to the first rotation axis.

Each of the image forming unit comprises the following units.

A photosensitive member pivots around a second rotation axis, a part of the photosensitive member exposing from a circular arc surface of the image forming unit.

A developing unit contains a color toner.

The second rotation axis may be parallel to the first rotation axis, and a slit for leading a signal light may be provided between the first rotation axis and an exposure position provided on a surface of the photosensitive member.

The image forming unit may be detachable from the color electrophotographic apparatus and further comprise an openable drum-cover for protecting the exposed part of the photosensitive member, and a cover opening unit for controlling the openable drum-cover to be selectively opened and closed.

While the drum-cover is opened, the cover opening unit may stay the drum-cover back from the outermost circular arc which is traced by the photosensitive members while the image forming units rotate.

The image forming unit may further comprise an energization unit for energizing the cover opening unit so that the drum-cover is closed.

A second object of the present invention is to provide a color electrophotographic apparatus which can simplify a repairing or inspecting work when a fly wheel is provided for maintaining a fixed peripheral speed of the photosensitive member during an image formation.

The second object can be achieved when the drive unit further includes the following:

A fly wheel is concentric with the rotation axis, and rotates independently of the rotation axis.

A conveyance unit conveys the driving force of the fly wheel to the photosensitive members when the image forming units stand on the image forming position.

The drive unit may further include a conveyance suspension unit for suspending the conveying operation of the conveyance unit to the photosensitive members when the image forming units are not located on the image forming position.

BRIEF DESCRIPTION OF THE DRAWING

These and other objects, advantages and features of the invention will become apparent from the following description thereof taken in conjunction with the accompanying drawings which illustrate a specific embodiment of the invention. In the drawings.

DESCRIPTION OF THE PREFERRED EMBODIMENT

<EMBODIMENT 1>

The color electrophotographic apparatus and image forming units of the embodiment will be described as follows with reference to attached drawings.

[Overall constructions and operations of the color electrophotographic apparatus and the image forming unit]

Figure 1:
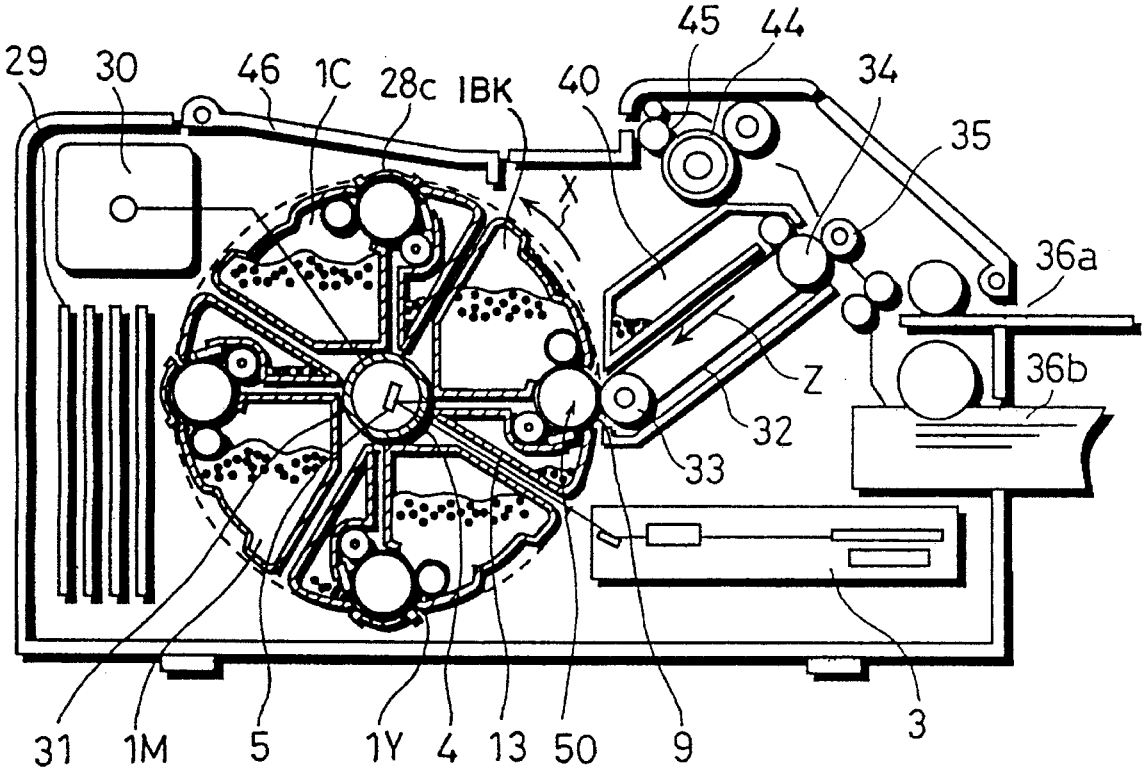
FIG. 1 shows an overall construction of the color electrophotographic apparatus of the embodiment.

FIG. 1 shows an overall construction of the color electrophotographic apparatus of the embodiment.

This apparatus includes an image generation unit for forming color toner images from image signals received from an external unit, an intermediate transfer unit for forming a color image by superimposing and transferring the toner images onto paper, paper feed units 36*a* and 36*b* for supplying paper, and a fixer 44 for fixing transferred toner images onto the paper.

The image generation unit is composed of a laser exposure unit 3 for emitting a signal light 13 for four colors in accordance with the image signals, image forming units 1Bk, 1Y, 1M, and 1C for forming a latent image onto a photosensitive drum 9 by receiving the signal light 13 and further forming toner images of different colors.

The image forming units 1Bk, 1Y, 1M, and 1C respectively for black yellow, magenta and cyan are all fan-shaped and arranged to form a circle as shown in FIG. 1 and placed approximately in the center of the apparatus. Each image forming unit is provided with a cylindrical photosensitive drum 9, a developer containing a color toner, and a cleaner.

The image forming units 1Bk, 1Y, 1M, and lC, which are supported by a frame 151 (refer to FIGS. 4 and 5), can be rotatable around a fixed cylindrical axis 31 in the X direction. The rotating operations of the frame and the image forming units are driven by a motor 30. The motor 30 is so controlled by a control circuit 29 shown in FIG. 1 that the four image forming units can sequentially reach an image forming position 50.

The laser exposure unit 3 is placed at a position lower than the fixed axis 31 and outside the image forming units. The laser exposure unit 3 generates the signal light 13 which is a laser beam modulated in accordance with image signals inputted from an external unit. The signal light 13 emitted from the laser exposure unit 3 goes straight to the fixed axis 31 along the wall of the cleaner which belongs to the image forming unit standing on the image forming position.

The fixed axis 31 includes therein a diagonally downward transparent window 4 to let the signal light 13 pass through, and a reflecting member such as a long mirror 5 in the direction of the axis of the fixed axis 31. The signal light 13 emitted from the laser exposure unit 3 passes the window 4 and is reflected by the mirror 5, thereby leading to a predetermined position on the surface of the photosensitive drum 9 standing on the image formation position 50. In the embodiment, the exposure position stands roughly as high as the mirror 5.

The signal light 13 proceeds diagonally upward to be reflected by the mirror 5 and proceeds in a horizontal direction to reach the exposure position.

The intermediate transfer unit includes an intermediate transfer belt 32 as a transfer member, a drive roller 34, and a first transfer roller 33 which is positioned in accordance with the predetermined transfer position. The transfer position stands on the surface of the photosensitive drum 9 of the image forming unit on the image forming position 50, transfer position which faces the exposure position. In other words, the exposure position lies inside the image forming unit and the transfer position outside the unit on the surface of the photosensitive drum 9.

The intermediate transfer belt 32 is made of semiconductive urethane film having a thickness of 100 μm, and rolled over a stainless drive roller 34 and a first transfer roller 33 made of urethane foam which has been through a low resistance process, thereby rotating in the Z direction. In the embodiment, the distance between the drive roller 34 and the first transfer roller 33 is so determined that the entire length of the intermediate transfer belt can be a little bit longer than the longitudinal length of A4 size paper.

The first transfer roller 33 is in a slight contact with the photosensitive drum 9 of the image forming unit standing on the image forming position (the unit 1BK in FIG. 1) having the intermediate transfer belt 32 therebetween. The drive roller 34 is in a slight contact with a second transfer roller 35 having the intermediate transfer belt 32 therebetween. The second transfer roller 35 has the same construction as the first transfer roller 33 and rotates in accordance with the drive roller 34.

The intermediate transfer unit further includes a belt cleaning unit 40 having a belt cleaner for cleaning the intermediate transfer belt 32.

The paper feed units 36*a* and 36*b*, which are placed besides the main body of the apparatus, send paper to a nipping portion between the intermediate transfer belt 32 and the second transfer roller 35. The paper feed unit 36*a* feeds paper that an operator put on the tray to the intermediate transfer unit and the paper feed unit 36*b* feeds paper in stock to the intermediate transfer unit.

The fixer 44 is provided above the belt cleaning unit 40 together with a paper discharge roller 45 for discharging toner-fixed paper, thereby providing a path for conveying paper from the paper feed units 36*a* and 36*b* up to the fixer 44 via the nipping portion. Furthermore, a lid 46 is provided above the main body of the apparatus, the lid 46 being opened for maintenance.

In the color electrophotographic apparatus having the above-explained construction, each image forming unit is sequentially moved to the image forming position 50 and positioned. The image forming position 50 faces the first transfer roller 33 which supports the intermediate transfer belt 32. When an image forming unit stands on the image forming position 50, the photosensitive drum 9 of the unit is pressed onto the first transfer roller 33 and at the same time, is exposed at a predetermined exposure position. The signal light 13 emitted from the laser exposure unit 3 goes through a light path formed between adjacent image forming units, and further goes through the window 4 of the fixed axis 31 to reach the mirror 5. Being reflected by the mirror 5, the signal light 13 goes to the surface of the photosensitive drum 9 of the image forming unit which stands on the image forming position, thereby forming an electrostatic latent image onto the surface of the drum 9. In the status shown in FIG. 1, the signal light 13 goes through the path formed between the image forming units 1Bk and 1Y, and is reflected by the mirror 5 to reach the photosensitive drum 9 of the image forming unit 1Bk.

The light path for leading the signal light 13 to the mirror 5 is formed between the wall of the image forming unit standing on the image forming position 50 and the wall of a lower adjacent image forming unit. In other words, each radial gap between adjacent image forming units is made to be a light path, so that the area for the image forming units does not need to be so large as to make room for the light path. In addition, the mirror 5 is fixed in the center of the circle formed with the image forming units, so that it does not interfere with the rotating operation of the image forming units. This feature provides a simple and highly reliable construction for positioning the latent images. Furthermore, the mirror 5 is provided inside the fixed axis 31 and the light path is designed to make the reflection surface of the mirror 5 and the window 4 downward, in order to prevent dust or toner scattered around from gathering on the surface of the mirror 5 or on the window 4.

The following is a description on the image forming units. Since all the four image forming units 1Bk, 1Y, 1M, and 1C have the same construction except for developing material to be contained therein, the following description is focused on the image forming unit 1Bk for black. Components common to all the image forming units are referred to by the same reference number.

Figure 2:
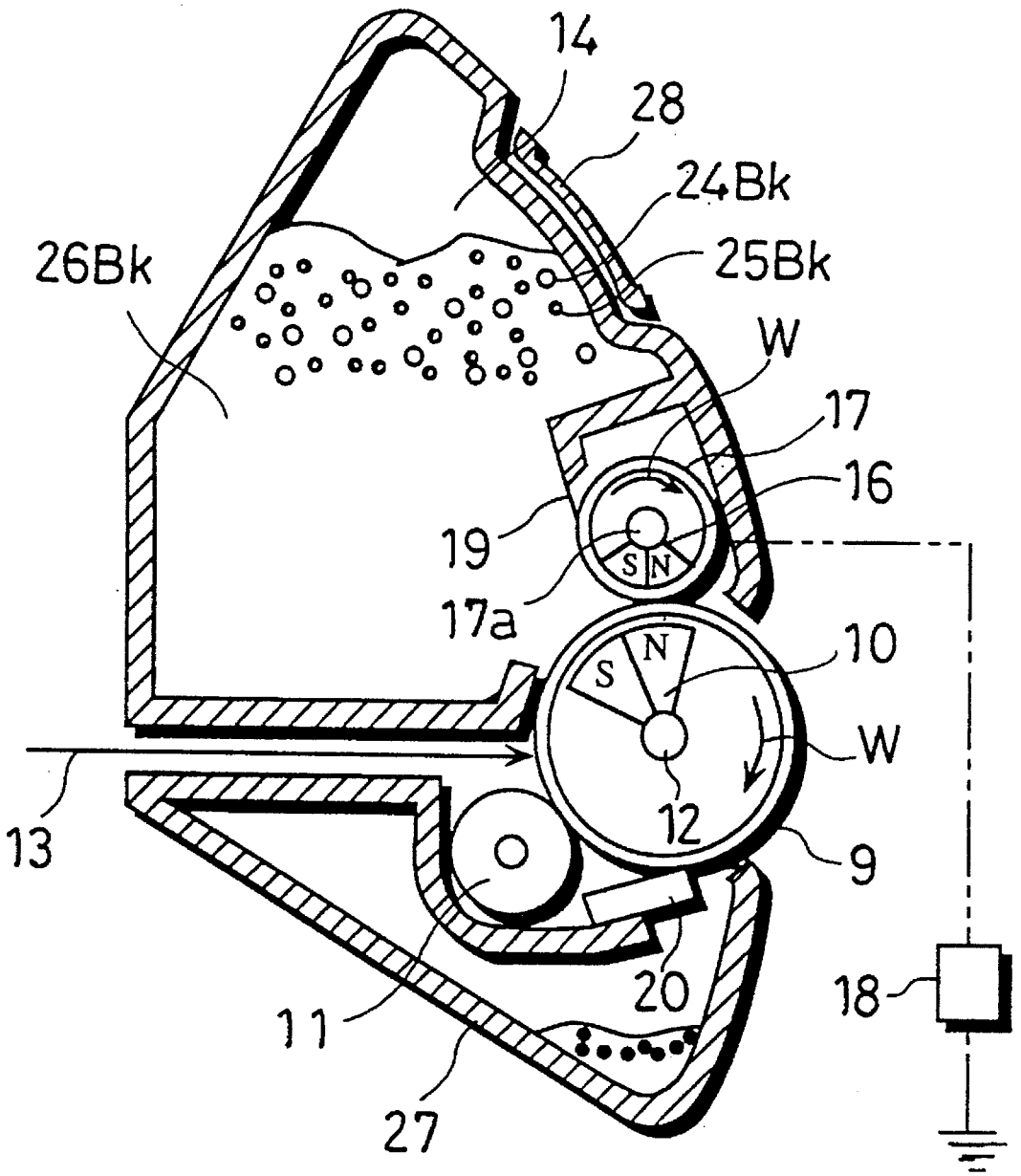
FIG. 2 shows a sectional view of the image forming unit 1Bk in the apparatus of the embodiment.

FIG. 2 shows a sectional view of the image forming unit 1Bk which includes the photosensitive drum 9, a charge roller 11, a developer collection roller 17, a hopper 14 containing a developing material 26Bk, and a cleaner 27.

The photosensitive drum 9 is designed to be rotatable around the fixed axis 12 and the surface of the drum 9 is composed of an organic photosensitive member made from a polycarbonate binder resin and phthalocyanine dispersed in the polycarbonate binder resin. The photosensitive drum 9 has a magnet 10 fixed on the axis 12 for attracting the developing material 26Bk on the surface thereof. A charge roller 11 is provided in contact with the surface of the drum 9 for negatively charging the entire surface of the drum 9.

As shown in FIG. 2, the fan shape of the sectional view of the unit Bk1 is formed by the hopper 14 and the cleaner 27. When the unit Bk1 is on the image forming position, the hopper 14 stands above the drum 9 and the cleaner 27 stands below the drum 9 for cleaning toner which remains on the surface of the drum 9 after every transfer operation. The hopper 14 and the cleaner 27 are so disposed to make a light path therebetween for leading the signal light 13 which has been reflected by the mirror 5 to the exposure position.

The developer collection roller 17, which is rotatable around the fixed axis 17*a* made of aluminum, is provided very closely to the photosensitive drum 9. The developer collection roller 17 has a magnet 16 fixed to the axis 17*a* for attracting the developing material 26Bk, and the hopper 14 is provided with a scraper 19, which is made of polyester, for scraping toner gathered on the developer collection roller 17.

The cleaner 27 is provided with a cleaning blade 20 made of urethane rubber for cleaning off toners which remain on the surface of the photosensitive drum 9.

An AC high voltage source 18 for applying high voltage to the developer collection roller 17 is provided outside the image forming units.

The photosensitive drum 9 whose diameter is 30 mm and the developer collection roller 17 whose diameter is 16 mm both rotate at a peripheral speed of 60 mm/s in the direction of "W" that is shown in FIG. 2.

The hopper 14 has two-component developing material 26Bk which is composed of a toner 25Bk and a ferrite carrier 24Bk whose surface is coated with a silicone resin. The particles of the ferrite carrier 24Bk is 50 μm. The toners used in the embodiment are made by dispersing pigments to a polyester resin and further adding an additive agent thereto.

The following is an operational description of the image forming unit Bk1 with reference to FIG. 2.

First, the photosensitive drum 9 of the unit Bk1 is charged through the charge roller 11 at −500V and then exposed to the signal light 13, thereby forming an electrostatic latent image. At this point, the exposure potential of the surface of the drum 9 is −100V. Then, the ferrite carrier 24Bk is attracted by the magnet 10 and as a result, the two-component developing material 26Bk contained in the hopper 14 is fixed onto the surface of the drum 9.

The drum 9 having the two-component developing material 26Bk thereon passes in front of the developer collection roller 17, thereby forming a toner image onto the surface thereof as follows.

When an uncharged area on the photosensitive drum 9 passes by at the beginning of a rotation, the developer collection roller 17 is applied 750Vo-p (peak to peak 1.5 kV) AC voltage (1 kHz frequency), into which 0V direct current has been superimposed, from the AC high voltage source 18. As a result, all the carriers and toners on the drum 9 are collected by the developer collection roller 17, leaving nothing there.

After the photosensitive drum 9 is charged a voltage of −500V, when an area on the drum 9 having an electrostatic latent image thereon passes by, the developer collection roller 17 is applied 750V0-p (peak to peak 1.5 kV) AC voltage (1 kHz frequency), into which −350V direct current has been superimposed. As a result, carriers on the drum 9 and toners fixed on the charged area are collected by the developer collection roller 17, leaving an expected toner image on the drum 9. The carriers and toners fixed onto the developer collection roller 17 is scraped by the scraper 19 and returned to the hopper 14 to be used for the next image forming operation. Hence, a black toner image is formed on the drum 9.

As described above, the hopper 14 containing the developing material 26Bk stands above the drum 9 and the cleaner 27 stands below the drum 9, so that developing operations and cleaning operations can be carried out smoothly without any mechanism for moving or mixing the developing material or toners. This is because the developing material in the hopper 14 can be conveyed onto the drum 9 with its own weight, and the toners in the cleaner 27 scraped by the cleaning blade 20 fall down from the drum 9 with its own weight. The other image forming units 1Y, 1M, and 1C have the same construction and operations.

In addition, the image forming units 1Bk, 1Y, 1M, and 1C are respectively provided with the drum-covers 28Bk, 28Y, 28M, and 28C to protect its own drum 9. In FIG. 2, one of the covers is open for image formation. Each image formation unit can be detached from the main body of the apparatus when it stands in the uppermost position (at the position of the unit 1C in FIG. 1). The construction and operation of the drum-covers 28Bk, 28Y, 28M, and 28C and the detaching operation of the image forming unit will be detailed later.

[Main operations of the color electrophotographic apparatus]

The following are main operations for forming color images by the color electrophotographic apparatus of the embodiment with reference to FIGS. 1 and 2.

Each image forming unit is positioned as shown in FIG. 1, where the image forming unit 1Bk for black stands on the image forming position 50.

A signal light for black is emitted to the image forming unit 1Bk by the laser exposure unit 3, to form a black image by a black toner. At this time, the image forming speed of the image forming unit 1Bk (identical to the peripheral speed of the photosensitive drum 9) and the transfer speed of the intermediate transfer belt 32 are set to be equal. A black toner image formed on the drum 9 is transferred onto the intermediate transfer belt 32 through the first transfer roller 33 which is applied a positive voltage during a transfer operation.

After the black toner image has been transferred, the image forming units 1Bk, 1Y, 1M, and 1C rotate 90 degrees in the direction of X by the transfer motor 30 until the unit 1Y reaches the image forming position 50. The position of the unit 1Y is fixed by a positioning mechanism which will be described later.

Since the hopper 14 and the cleaner 27 are positioned inside of the outermost arc drawn by the photosensitive drums 9, the intermediate transfer belt 32 does not touch the unit 1Y during a rotating operation.

After the unit 1Y has reached the image forming position 50, the laser exposure unit 3 sends a signal light for yellow to the unit 1Y to form and transfer a yellow image in the same manner as the black image. The timing of exposing the yellow signal light is so controlled that the yellow toner image is successfully superimposed on the black toner image when the intermediate transfer belt 32 has made a round. During the transfer operation, the second transfer roller 35 and the belt cleaning unit 40 are put away from the intermediate transfer belt 32, giving no effect on the toner image.

These operations are applied in the same manner to magenta and cyan images to finally superimpose four toner images together in the same position on the intermediate transfer belt 32, thereby forming a color image. After the cyan toner image has been transferred, the color image is transferred onto the paper which has been supplied from the paper feed units 36*a* or 36*b* through the second transfer roller 35, which has been applied a positive voltage. Then, the toner image transferred on the paper is fixed thereon by the fixer 44, and the paper is sent out of the apparatus by the paper discharge roller 45. The toner remaining on the belt 32 is cleaned off by the belt cleaning unit 40.

The following is an operational description in a single color mode of the apparatus of the embodiment. In a single color mode, one image forming unit for a desired color is transferred to the image forming position and positioned. Then, a desired-color image is formed and transferred onto the intermediate transfer belt 32 in the same manner as above, and the transfer operation is continued with paper which is sent from the paper feed units 36*a* or 36*b* through the second transfer roller 35.

[Mechanism and operation for opening and closing the drum-covers]

Figure 3:
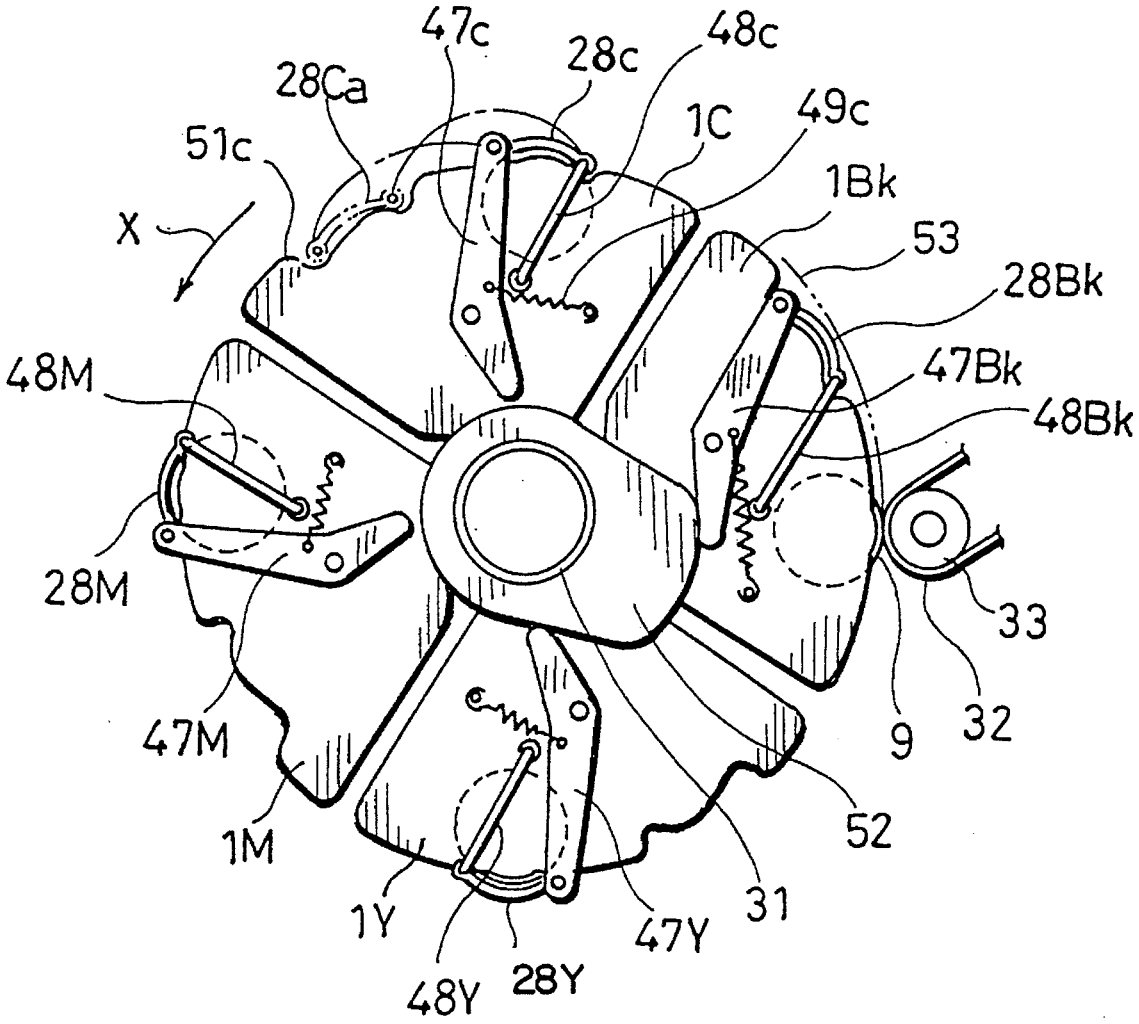
FIG. 3 is a sectional view of the opening and closing mechanism of the drum-covers of the apparatus of the embodiment.

FIG. 3 is a sectional view of the opening and closing mechanism of the drum-covers provided at one side of the image forming units when it is viewed from the same direction as FIG. 1. Each image forming unit is put in the same position as in FIG. 1.

Each of the drum-covers 28Bk, 28Y, 28M, and 28C is supported by the pivotable levers 47 and 48 attached at a side of the image forming unit. In the case of the unit 1C for cyan, the drum-cover 28C protects the drum 9 with the support of the spring 49C as indicated with the full line. On the other hand, when the lever 47C is rotated in the left direction, the drum-cover 28C traces the arcs indicated with the dashed lines and the drum-cover 28C reaches a pit 51C on the outer surface of the unit 1C. As a result, the drum-cover 28C is placed as indicated with the two dashed line 28C*a*.

The drum-cover 28, which is thus designed to be openable, can be open on the image forming position by providing the cam mechanism including a cam 52 as follows.

As shown in FIG. 3, the shape of the cam 52, which is fixed to the fixed axis 31, allows the drum-cover 28Bk to be put into the pit 51 by pressing the lever 47 while the image forming unit 1Bk is passing by the first transfer roller 33.

The cam 52 does not work on the levers 47Y, 47M, and 47C for the units 1Y, 1M and 1C respectively that are not on the image forming position. The drum-covers 28Y, 28M, and 28C are closed by the support of the springs 49Y, 49M, and 49C respectively.

Thus, each of the image forming units rotating in the X direction opens its own drum-cover before it reaches the image forming position and closes the drum-cover leaving the position. When the drum-covers are put in the pit 51, they are positioned inside of the outermost arc drawn by the photosensitive drums 9 (indicated by two-dashed line 53 in FIG. 3). Therefore the drum-covers do not touch the intermediate transfer belt 32 during the rotation of the image forming units.

[Driving mechanism of the image forming units]

The driving mechanism of the image forming units will be described as follows with reference to FIGS. 4 and 5.

Figure 4:
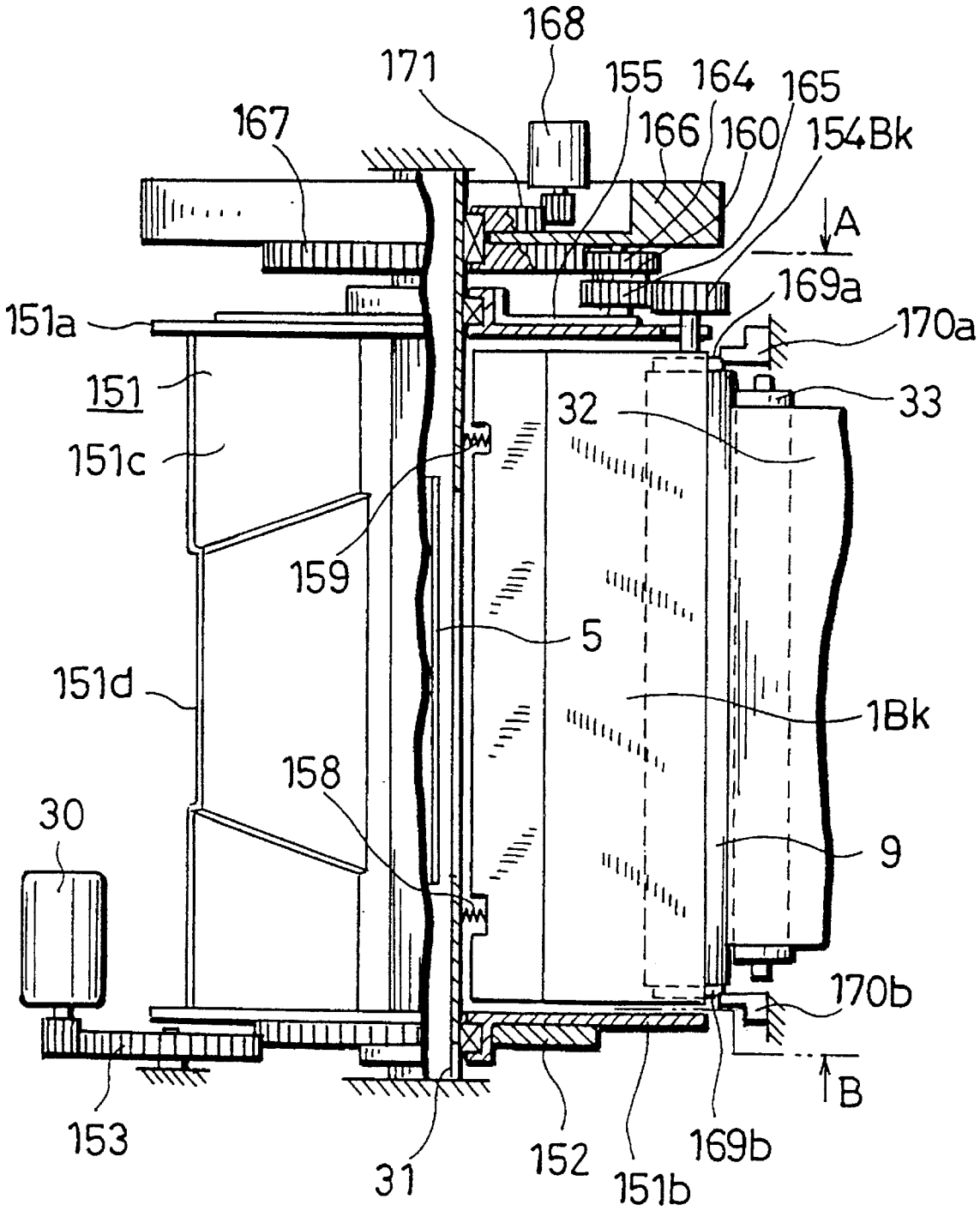
FIG. 4 is a top sectional view of the image forming units and their driving mechanism of the apparatus of the embodiment.

FIG. 4 shows a top sectional view of the image forming units and their driving mechanism. In the drawing, only the unit 1Bk among the four units is installed to make the explanation easy. The drum-cover opening mechanism is also omitted.

Figure 5:
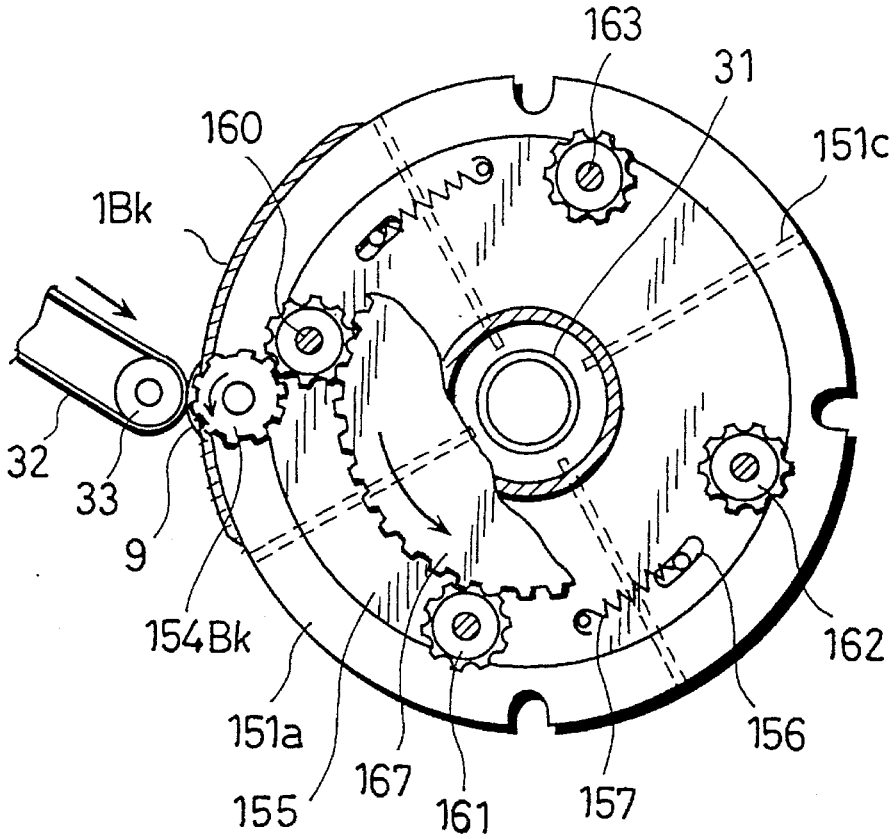
FIG. 5 shows a part of the driving mechanism of the image forming units of the apparatus of the embodiment.

As shown in FIG. 5, the main part of the frame 151 for supporting the four image forming units 1Bk, 1Y, 1M, and 1C is composed of disks 151*a* and 151*b* and four radial boarder plates 151*c* provided between adjacent image forming units to connect the disks 151*a* and 151*b*. Each of the border plates 151*c* has a hollow portion 151*d* to make room for the signal light 13 to reach the mirror 5.

The frame 151 is supported to be rotatable around the fixed axis 31, and each image forming unit is separated by the border plates 151*c*. In order to constitute the positioning mechanism which will be described below, each image forming unit is designed to be slightly movable toward the center of the frame 151 and energized in an outer direction by the springs 158 and 159. Each image forming unit is detachable from the frame 151.

A gear 152 is provided on the outer surface of the disk 151*b* to make the frame 151 rotate with the intermediate gear 153 in accordance with the rotation of the gear 152 which is driven by the transfer motor 30.

The following is a description on the rotating operation of the photosensitive drum 9.

A fly wheel 166 is supported to be rotatable around the fixed axis 31 and a gear 167 works cooperatively with the fly wheel 166 along the outer surface of the disk 151*a*. The fly wheel 166 is driven by a drive motor 168 via the gear 171 provided inside it.

On the other hand, a drum gear 154, which is directly connected to the axis of the drum 9 of the image forming unit 1Bk, projects from the disk 151*a*. A clutch disk 155 is supported to be rotatable around the axis 31 and rotates relatively to the frame 151.

FIG. 5 shows the clutch disk 155 and the frame 151, when they are viewed from the direction indicated with the arrow A shown in FIG. 4. The clutch disk 155 can rotate relatively to the disk 151*a* within the range determined with the long hole 156, and energized in the counter-clock direction against the disk 151*a*. The clutch disk 155 is further provided with four clutches 160–163 which are positioned to be concentric with the disk 155 and further to correspond to the drum gear 154 of each image forming unit.

In FIG. 4, the clutch 160 can connect and disconnect the driving force between the two gears 164 and 165 according to an external signal. The other clutches than the clutch 160 are not shown in FIG. 4 to make the drawing simple. The gear 165 of the clutch 160 is engaged with the drum gear 154Bk and the other gear 164 is engaged with the gear 167 which works cooperatively with the fly wheel 166. Accordingly, when the clutch 160 is connected, the driving force of the fly wheel 166 is conveyed to the drum 9, and otherwise the driving force is suspended.

[A mechanism for the image forming units to be positioned on the image forming position]

As shown in FIG. 4, the color electrophotographic apparatus of the embodiment is provided with positioning stands 170*a* and 170*b* in accordance with the transfer position. In addition, collars 169*a* and 169*b* are provided at both ends of each photosensitive drum 9 to be engaged with the positioning stands 170*a* and 170*b*. In FIG. 4, the collars 169*a* and 169*b* of the image forming unit 1Bk on the image forming position are engaged with the V-shaped groove of the positioning stands 170*a* and 170*b* for positioning.

Figure 6:
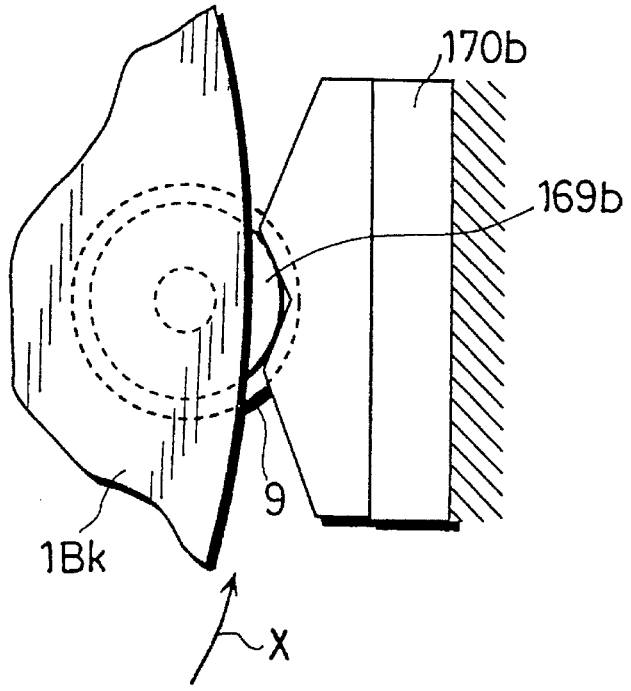
FIG. 6 shows one of the image forming units of the apparatus of the embodiment, which has been positioned.

FIG. 6 shows the collar 169*b* which has been positioned, when it is viewed from the direction indicated with the arrow B in FIG. 4.

Since each image forming unit is slightly movable toward the center of the frame 151 and also energized in an outer direction by the springs 158 and 159, in the process of forming a color image the collar 169*b* goes up a slope of the positioning stand 170*b* until it is engaged with the V-shape groove. In this state, the image forming unit in the V-shape groove stands back toward the center of the rotation, as compared with the other image forming units. When an image is formed, the image forming units are positioned as explained above. This allows the center position of the photosensitive member of each image forming unit to be positioned accurately, and as a result, images are always exposed and transferred in the right position. Furthermore, occurrence of an error in the stop position of the frame does not affect the positioning.

[Main operations for driving and positioning the image forming units]

In FIG. 4, the gear 167, which is driven by the drive motor 168, rotates very smoothly with little speed fluctuation during an image forming process.

Among the clutches 160–163, one which corresponds to the unit in process of image formation on the image forming position is in a connected state, and the other clutches are disconnected. In FIG. 5, only the clutch 160 is connected. Since the unit on the image forming position is positioned as above, its photosensitive drum 9 and the drum gear (154Bk in FIG. 5) stand back toward the fixed axis 31, as compared with those of the other units. Therefore, the backlash of the engagement between the clutch 160 and the drum gear 154Bk is minimized because the clutch disk 155 is energized in the counter-clock direction, so that the transmission of the driving force is very smooth.

On the other hand, the units protruding a little cause considerable backlash of the engagement between the drum gears of the other image forming units and the respective clutches; however, no trouble is caused on the rotating operations because the clutches are in a off state. The engagement between the gear 167 and each clutch is kept smooth regardless of the rotating position of the clutch disk because the clutch disk 155 and the gear 167 are concentric.

As described hereinbefore, in the embodiment, the fly wheel 166*a* serves to transfer the driving force with very little fluctuation to the photosensitive drum 9 of the image forming unit in process of image formation. As a result, clear toner images with little jittering, which is caused by rotating fluctuation, can be obtained.

[Description on the maintenance of the color electrophotographic apparatus]

When the apparatus needs to be checked, for example, because a certain color developing material runs out, the control circuit 29 drives the transfer motor 30 to rotate the image forming units according to the direction of the operator through an unillustrated switch. As a result, the image forming unit for a desired color is moved to the uppermost position (where the unit 1C stands in FIG. 1) from which the units are detached from the apparatus.

Figure 7:
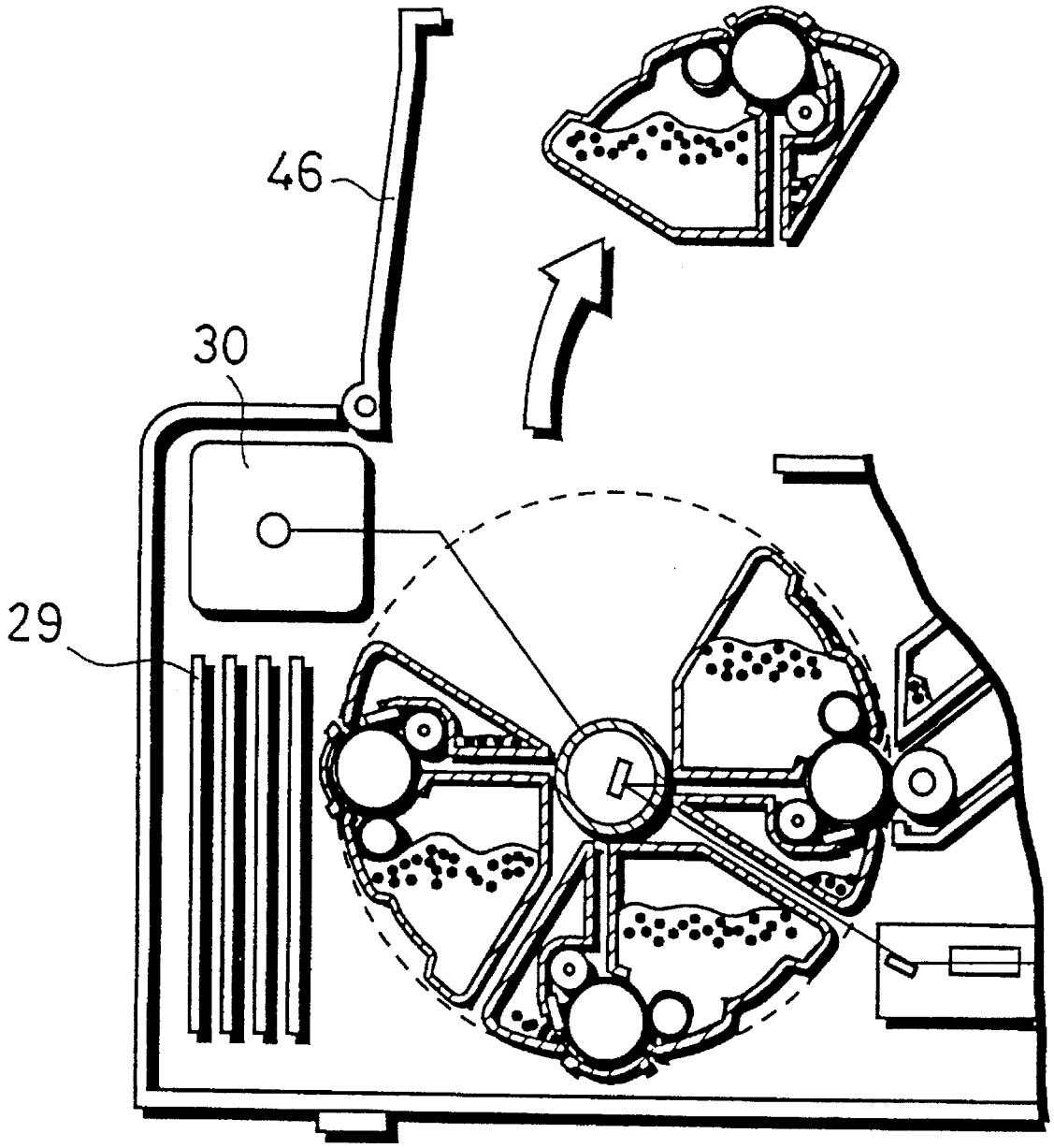
FIG. 7 shows the detaching operation of one image forming unit of the apparatus of the embodiment.

Then, as shown in FIG. 7, the operator can replace the outstanding image forming unit with another by opening the lid 46, without touching the photosensitive drum 9 because the drum-cover is closed. Thus, an image forming operation can be resumed without any adjustment after the image forming unit is attached.

Since the exchange of the image forming units is not performed on the image forming position, a desired unit can be taken out easily without being obstructed by neighboring members such as the intermediate transfer unit.

[Effects of the color electrophotographic apparatus]

According to the color electrophotographic apparatus constructed as above, the four toner images are all formed on the same position and then all transferred onto the same position, so that the toner images of different colors can be superimposed accurately.

The image forming units are independent of each other and can be replaced by a new one separately with ease, or repaired outside of the apparatus.

In addition, to place the mirror 5 about the center of the image forming units can make the construction of the image forming units simple and compact, thereby realizing the compact apparatus.

To arrange the fan-shaped image forming units in the form of a circle can eliminate wasteful space, using a gap between adjacent image forming units as a light path, thereby minimizing the image forming units.

Since the photosensitive drums 9 are not rotating when they are not on the image forming position, their fatigue which is caused by electrostatic during successive formation of color images can be mitigated. As a result, clear images can be expected for a long period of time.

When an image forming unit stands on the image forming position, its developing material is positioned above its cleaner, no mechanism for moving or mixing the developing material or toners is necessary. As a result, the construction of the image forming units can be simple and compact.

The attaching or detaching operation of the image forming units does not spoil their photosensitive drums 9 because they are protected with the drum-covers 28. Furthermore, the image forming units that are not standing on the image forming position are protected with the drum-covers 28, so that their photosensitive drums 9 are protected from dust or toners. Furthermore, the mirror 5 is provided inside the fixed axis 31 and the light path is designed to make the reflection surface of the mirror 5 and the window 4 downward, so that the surface of the mirror 5 and the window 4 can be kept away from dust or toner scattered.

Furthermore, the photosensitive drum 9 of the image forming unit in process of forming images is driven by the gear 167 which is directly connected with the fly wheel 166, the drum 9 can rotate smoothly with very little fluctuation. Thus, clear color toner images with little jittering can be obtained from the single fly wheel.

[Others]

Instead of the developing method which is used for the color electrophotographic apparatus and the image forming units in the embodiment, other methods such as magnetic brush developing can be used as well.

In the embodiment, toner images formed on the photosensitive member are transferred onto the intermediate transfer belt of the intermediate transfer unit, and then transferred onto paper all at once. However, an intermediate transfer drum can be used instead of the intermediate transfer belt, or the toner images can be transferred from the photosensitive member to the paper which is rolled over the transfer drum.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A color electrophotographic apparatus for forming a color image by superimposing and transferring a plurality of toner images onto a transfer material, each of said toner images having a color different from others, said apparatus comprising:

a plurality of image forming units, each of the plurality of image forming units forming a corresponding one of said plurality of toner images and including a rotating photosensitive member on which a toner image is formed and a developing means which contains a color toner, said plurality of image forming units being so arranged in a form of a cylinder to be rotated around a rotation axis, the cylinder providing a space around the rotation axis;

a transfer means for transferring a toner image formed on said photosensitive member onto a transfer member, a transferring operation of a toner image being performed on a transfer position in said color electrophotographic apparatus;

a light emitting means for emitting a signal light directed towards said rotation axis from outside of said image forming units;

a rotation means for rotating said image forming units around said rotation axis so that said image forming units reach an image forming position in sequence, said image forming position corresponding to said transfer position;

a drive means for rotating said photosensitive member of an image forming unit when the image forming unit is positioned on said image forming position;

a mirror for reflecting said signal light emitted by said light emitting means to lead to said image forming position, said mirror being placed within the space adjacent the rotational axis; and adjacent ones of said image forming units having a gap therebetween, said gaps extending in radial directions from the rotational axis and aligning with the mirror when the image forming unit is positioned at said image forming position, whereby the arrangement of the image forming units, with a gap between adjacent image forming units providing a light path to the mirror, enables a compact electrophotographic apparatus to be provided.

2. The color electrophotographic apparatus of claim 1, wherein each of said image forming units has a substantially fan-shaped section vertical to said rotation axis, and said image forming units arranged in the form of a circle have a circular section vertical to said rotation axis.

3. The color electrophotographic apparatus of claim 1 further comprises a fixed cylindrical axis, which is one of being entirely transparent and having a transparent window, said fixed cylindrical axis being concentric with said rotation axis, and wherein said mirror is placed inside of said fixed cylindrical axis.

4. The color electrophotographic apparatus of claim 3, wherein said fixed cylindrical axis is horizontal, said light emitting means emits said signal light from a lower position than said mirror, and a reflection surface of said mirror is diagonally downwards.

5. The color electrophotographic apparatus of claim 1, wherein each of said image forming units further includes a cleaning means for cleaning off toners on said photosensitive member, and wherein when a said image forming unit stands at said image forming position, said developing means thereof is positioned above said photosensitive member thereof and said cleaning means thereof is positioned below said photosensitive member.

6. The color electrophotographic apparatus of claim 1 further comprising:

a plurality of openable drum-covers for protecting a respective one of said photosensitive members of said image forming units; and a cover opening means for controlling an opening and closing operation of said drum-covers in accordance with a rotating operation of said image forming units and for opening said drum-cover of a said image forming unit standing at said image forming position.

7. The color electrophotographic apparatus of claim 6, wherein said image forming units are detachable from said color electrophotographic apparatus when said image forming units are located at a predetermined position, said predetermined position being other than said image forming position, and said cover opening means keeps said drum-covers closed when said image forming units are located other than said image forming position.

8. The color electrophotographic apparatus of claim 7, wherein when said image forming units pass by said transfer position, said drum-covers thereof stay back from an outermost circular arc which is traced by said photosensitive members while said image forming units rotate.

9. The color electrophotographic apparatus of claim 1, wherein said drive means includes:

a driving gear which is concentric with said rotation axis, said driving gear rotating independently of said rotation axis; and a conveyance means for conveying a driving force of said driving gear to said photosensitive members when said image forming units stand at said image forming position.

10. The color electrophotographic apparatus of claim 9, wherein said drive means further includes a conveyance suspension unit for suspending a conveying operation of said conveyance means to said photosensitive members when said image forming units are located other than said image forming position.

11. The color electrophotographic apparatus of claim 1, wherein said drive means further includes:

a fly wheel which is concentric with said rotation axis, said fly wheel rotating independently of said rotation axis; and a conveyance means for conveying a driving force of said fly wheel to said photosensitive members when said image forming units stand at said image forming position.

12. The color electrophotographic apparatus of claim 11, wherein said drive means further includes a conveyance suspension unit for suspending a conveying operation of said conveyance means to said photosensitive members when said image forming units are located at other than said image forming position.

13. The color electrophotographic apparatus of claim 1 wherein said rotation means includes a frame for holding said image forming units in a body; and a positioning means for positioning said image forming units at said image forming position, separately from said frame.

14. The color electrophotographic apparatus of claim 1 further including a cover member movably mounted on a peripheral outer portion of each image forming unit to cover the photosensitive member and automatic means at the image forming position to move the cover member to expose the photosensitive member to the transfer means.

15. The color electrophotographic apparatus of claim 14, wherein the automatic means includes a cam, a follower lever and a spring member, wherein the follower lever is connected to the cover member and spring biased by the spring member to cover the photosensitive member and the cam is positioned to contact the follower lever adjacent the image forming position and to force the follower lever against the spring bias to move the cover member and expose the photosensitive member.

16. The color electrophotographic apparatus of claim 14 further including means for radially displacing an image forming unit towards the rotation axis, when operatively positioned at the image forming position the remaining image forming units being radially displaced outwardly compared to the image forming unit at the image forming position.

17. An image forming unit, a plurality of image forming units are used in a color electrophotographic apparatus for forming a color image by superimposing and transferring a plurality of toner images onto a transfer material at a transfer position, the plurality of image forming units being so arranged as to form a cylindrical section about a first rotation axis and being rotated around said first rotation axis, thereby sequentially reaching an image forming position, and each of said image forming units having a substantially fan-shaped section extending from said first rotation axis, whereby a light emitting means emits an image forming light directed toward said first rotation axis, and said image forming light can be redirected radially outward from said first rotation axis, said image forming unit comprising;

a fan-shaped housing member;

a photosensitive member pivotable around a second rotation axis in said housing member, a part of said photosensitive member being exposed along a circular arc surface of said image forming unit; and a developing means, in said housing member, which contains a color toner for contacting said photosensitive member, wherein said second rotation axis is parallel to said first rotation axis, and a slit for leading a signal light is provided in said housing member between said first rotation axis and an exposure position provided on a surface of said photosensitive member, whereby the mounting of a plurality of fan-shaped housing members about said first rotation axis, with gaps between adjacent fan-shaped housing members, enables a compact electrophotographic apparatus to be provided with the gaps permitting said image forming light from said light emitting means to be directed toward said first rotation axis.

18. The image forming unit of claim 17 being detachable from said color electrophotographic apparatus and further comprises:

an openable drum-cover for protecting the exposed part of said photosensitive member; and a cover opening means for controlling said openable drum-cover to be selectively opened and closed.

19. The image forming unit of claim 18, wherein while said drum-cover is opened, said cover opening means stays said drum-cover back from an outermost circular arc which is traced by said photosensitive members while said image forming units rotate.

20. The image forming unit of claim 18 further comprising an energization means for energizing said cover opening means so that said drum-cover is closed.

21. The color electrophotographic apparatus of claim 17 further including a cover member movably mounted on a peripheral outer portion of each image forming unit to cover the photosensitive member and automatic means at the image forming position to move the cover member to expose the photosensitive member.

22. The color electrophotographic apparatus of claim 21, wherein the automatic means includes a cam, a follower lever and a spring member, wherein the follower lever is connected to the cover member and spring biased by the spring member to cover the photosensitive member and the cam is positioned to contact the follower lever adjacent the image forming position and to force the follower lever against the spring bias to move the cover member and expose the photosensitive member.

23. The color electrophotographic apparatus of claim 21 further including means for radially displacing an image forming unit towards the first rotation axis, when operatively positioned at the image forming position the remaining image forming units being radially displaced outwardly compared to the image forming unit at the image forming position.

24. A color electrophotographic apparatus for forming a color image by superimposing and transferring a plurality of toner images onto a transfer material, each of the toner images having a different color and the transfer occurring at an image forming station, comprising:

means for providing copying sheets;

a plurality of image forming units, each image forming unit including a rotatable photosensitive member and a source of toner;

a support member, the image forming units being arranged to rotate about a first rotational axis, and rotatably mounted on the support member;

first means for rotating the support member about the first rotational axis;

transfer means for transferring an image from a photosensitive member to a copy sheet at the image forming station;

second means for selectively rotating a photosensitive member relative to the transfer means, including a fly wheel member;

means for rotating the fly wheel member;

a clutch assembly for operatively and selectively engaging only the photosensitive member, which is positioned at the image forming station, with the fly wheel; and means for radially displacing an imaging forming unit towards the first rotational axis, when operatively positioned at the image forming station, the remaining image forming units being positioned to be radially displaced outwardly relative to the image forming unit at the image forming station.

25. The color electrophotographic apparatus of claim 24 further including a cover member movably mounted on a peripheral outer portion of each image forming unit to cover the photosensitive member and automatic means at the image forming station to move the cover member to expose the photosensitive member to the transfer means.

26. The color electrophotographic apparatus of claim 25, wherein the automatic means includes a cam, a follower lever and a spring member, wherein the follower lever is connected to the cover member and spring biased by the spring member to cover the photosensitive member and the cam is positioned to contact the follower lever adjacent the image forming station and to force the follower lever against the spring bias to move the cover member and expose the photosensitive member.

27. A color electrophotographic apparatus for forming a color image by superimposing and transferring a plurality of toner images onto a transfer material, each of said toner images having a color different from others, said apparatus comprising:

a plurality of image forming units, each of the plurality of image forming units forming a corresponding one of said plurality of toner images and including a rotating photosensitive member on which a toner image is formed and a developing means which contains a color toner, said plurality of image forming units being arranged to be rotated around a rotation axis;

a reflecting member fixedly mounted on the rotation axis so that the image forming units will revolve around the reflecting member;

a transfer means for transferring a toner image formed on said photosensitive member onto a transfer member, a transferring operation of a toner image being performed on a transfer position in said color electrophotographic apparatus;

a light emitting means for emitting a signal light towards said rotation axis from outside of said image forming units to contact and be reflected from the reflecting member;

a rotation means for rotating said image forming units around said rotation axis so that said image forming units reach an image forming position in sequence, said image forming position corresponding to said transfer position;

a drive means for rotating said photosensitive member of an image forming unit when the image forming unit is rotated to said image forming position; and adjacent ones of said image forming units having a gap therebetween and at least a part of said gap being a part of a light path for leading said signal light from said light emitting means to said reflecting member, whereby the arrangement of the image forming units, with a gap between adjacent image forming units providing a light path to the reflecting member, enables a compact electrophotographic apparatus to be provided.

* * * * *